United States Patent [19]

Roberts

[11] 4,131,754

[45] Dec. 26, 1978

[54] AUTOMATIC MELT RATE CONTROL SYSTEM FOR CONSUMABLE ELECTRODE REMELTING

[75] Inventor: Raymond J. Roberts, West Berlin, N.J.

[73] Assignee: Consarc Corporation, Rancocas, N.J.

[21] Appl. No.: 793,005

[22] Filed: May 2, 1977

[51] Int. Cl.[2] ..... H05B 7/148

[52] U.S. Cl. ..... 13/34; 13/12

[58] Field of Search ..... 13/9, 12, 13, 9 ES, 13/34

[56] References Cited

U.S. PATENT DOCUMENTS

| | | | |
|---|---|---|---|
| 3,493,664 | 2/1970 | Kapell | 13/12 |
| 3,872,231 | 3/1975 | Motter et al. | 13/13 |

*Primary Examiner*—R. N. Envall, Jr.

*Attorney, Agent, or Firm*—Seidel, Gonda & Goldhammer

[57] ABSTRACT

A melt rate control system for consumable electrode remelting uses a closed loop control system to control electrical power and hence the electrode melt rate. The control equation is purposely adjusted to cause the melt rate to initially exceed the steady state melt rate in a controlled manner to take advantage of the higher permissible melt rate at the bottom of an ingot. Initially, the melting current is held at a steady level sufficiently high to cause the melt rate to exceed the steady state melt rate. The initial current is then reduced in a controlled manner to bring the melt rate to the steady state condition. The length of time and amount of excessive melt rate is matched to the higher permissible melt rate at the bottom of an ingot.

11 Claims, 2 Drawing Figures

(SSMR=STEADY STATE MELT RATE)

TYPICAL PROFILE OF CURRENT AND INDICATED MELT RATE

AUTOMATIC MELT RATE CONTROL SYSTEM FOR CONSUMABLE ELECTRODE REMELTING

This invention relates to a melt rate control system for consumable electrode remelting. More particularly, this invention relates to a closed loop control system in which the initial melt rate is purposely caused to exceed the set point melt rate to take advantage of the higher permissible electrode melt rates for forming the bottom of an ingot.

In the operation of consumable electrode furnaces, the electrode melting rate is an important variable which must be controlled by varying the power input to the process. The melt rate (which can be defined as the weight per unit of time at which the electrode is fused into molten metal) has a direct effect upon the quality of the remelted material in the furnace. Melt rates which are too high or too low can be deleterious to the quality of the ingot.

Ordinarily, the melt rate of an electrode is manually controlled while the electrode is being consumed. Typically, it is controlled by the furnace operating personnel who make periodic adjustments to the electric power level based upon melt rate computations made by observation of the decreasing weight of the electrode or the physical displacement of the electrode as the melt proceeds. The melt rate and adjustments in the melt rate are based upon numerous considerations including the particular melting process (i.e., electroslag remelting, vacuum arc remelting, or plasma arc remelting), the type of metal being remelted, electrode and crucible size, and the quality of the ingot to be produced. Not surprisingly, these factors are for the most part imperical and hence vary from metalmaker to metalmaker with the specific details of each metalmaker's process ordinarily being kept as a trade secret. But the factors are known and it remains only for the metalmaker to select the factors to be included and insert the proper values. Among these is the melt rate which must be regulated throughout the entire electrode melting process. Moreover, the melt rate can be and is varied in accordance with changes in certain measurable variables such as the weight of the electrode and/or its physical displacement as the melt proceeds. Hence, the remelting process lends itself to automation through the use of a closed loop control system for controlling the melt rate.

Closed loop control systems in industrial processes are not new nor is their use in conjunction with consumable electrode furnaces believed to be novel. The present invention, however, relates to a novel application of such closed loop control systems for consumable electrode remelting furnaces.

Typically, a closed loop control system detects the value of a controlled variable, such as temperature, power, current or voltage which is used as a feedback signal and automatically compares it with the value of a reference (or set point) signal which represents the desired value of the controlled variable. A control device acts on the difference between the actual and desired values of the controlled variable, altering the value of the controlled variable according to an established control equation, such that the value of the controlled variable is made equal to the reference value. Commonly used equations involve proportional control, proportional plus integral control, and proportional plus integral plus derivative control. Other more specialized equations are occasionally used where applicable. In some closed loop control systems, the controlled variable is required to vary in a predetermined manner with time. In these systems, the value of the reference signal is varied by means of auxiliary devices such as curve following programmers, motorized potentiometers, timers with relays, or computers. In all such systems, however, the objective of the control loop is to maintain the value of the controlled variable as close as possible to the reference value regardless of whether it is fixed or varies with time.

When a closed loop control system is initially started, the value of the controlled variable (or variables) is at zero or some low value and the closed loop control system acts to rapidly increase the value of the controlled variable toward the reference value. In some systems, the controlled variable does not cease increasing when it reaches the reference value, but instead increases to a value higher than the reference value before settling back toward the reference value. This phenomenon is generally known as "initial overshoot" and is generally considered to be undesirable. The control equation of the process or control device is therefore usually arranged to minimize initial overshoot to the extent possible.

The present invention goes against this conventional wisdom and indeed takes advantage of the initial overshoot to increase the productivity of consumable electrode furnaces. The indicated method of increasing furnace productivity is to increase the melt rate. But an increased melt rate deleteriously effects ingot quality. Notwithstanding such counterindications, the present invention initially increases the melt rate beyond the permissible melt rate as determined by the conventionally applied factors. In particular, the melt rate is permitted to exceed the permissible melt rate by a varying amount over an initial period of time in the electrode melting process. It has been discovered that the excessive melt rate can be used during the initial melt period because of the additional cooling of the remelted metal provided by the base plate of a furnace. The amount of excessive melt rate is significant enough to improve the productivity of the consumable electrode furnace, particularly in furnaces for manufacturing cylindrical ingots with a substantial diameter to height ratio or noncylindrical ingots of comparable dimensions. It is in furnaces of this type that the additional cooling of the remelted metal provided by the base plate is sufficient enough to productively make the maximum permissible melt rate significantly higher while manufacturing the bottom of the ingot and thus increase furnace productivity.

It has already been indicated that the melt rate is not constant throughout the entire period of time it takes to melt an electrode. Stated otherwise, the reference value of the melt rate in a closed loop control system varies as a function of time. However, it has been discovered that one of the advantages of the present invention is that by manipulating the control equation and initial melting conditions to encourage a controlled amount of melt rate initial overshoot, the required melt rate as a function of time may be obtained using a constant set point signal, thereby eliminating the need for auxiliary devices or program curves.

Melt rate is a function of the amount of electrical power and Δis a function of the amount of melting current, that is, the amount of current passing through the electrode. Hence, melt rate can be varied by adjusting the current passing through the electrode. It has been determined that the melting current (I Melt) that will cause the melt rate to exceed the set point melt rate can be defined according to the folowing equation:

$$I\ \text{Melt} = I\ \text{Manual} - \Delta I$$

where:

I Melt is the value of the melting current; and

I Manual is the initial current value fixed by the furnace operator.

This equation is valid once the melt rate reaches the set point of the closed loop control system.

ΔI is defined according to the following equation:

$$\Delta I = K_1 e + K_2 \int e \cdot dt + K_3\, de/dt$$

where:

e is the instantaneous difference between actual melt rate and the melt rate set point;

$K_1$ is a proportional constant;

$K_2$ is an integral constant; and $K_3$ is a rate constant.

The constants $K_1$, $K_2$ and $K_3$ are selected based upon tests to give the desired melt rate profile in conjunction with the selected value of I Manual. These constants vary depending upon material being melted, electrode and crucible sizes, and other factors known to metalmakers.

The melt rate profile is the graphical plot of the amount by which the melt rate exceeds melt rate set point over a period of time.

The foregoing equations can be advantageously used in a closed loop control system for the automatic control of melt rate in a consumable electrode remelting furnace in which the control equation and initial melting operations are selected to encourage a predetermined amount of initial overshoot of the melt rate above the set point melt rate reference value. The closed loop control is adjusted so that the power level is automatically reduced below the initial value once the melt rate has exceeded the reference value. The control equation to achieve this reduction in power level and the initial value of the power level are such that the resulting melt rate profile approximates the maximum melt rate which can be used while maintaining ingot quality.

For the purpose of illustrating the invention, there is shown in the drawings a form which is presently preferred; it being understood, however, that this invention is not limited to the precise arrangements and instrumentalities shown.

Figure 1:
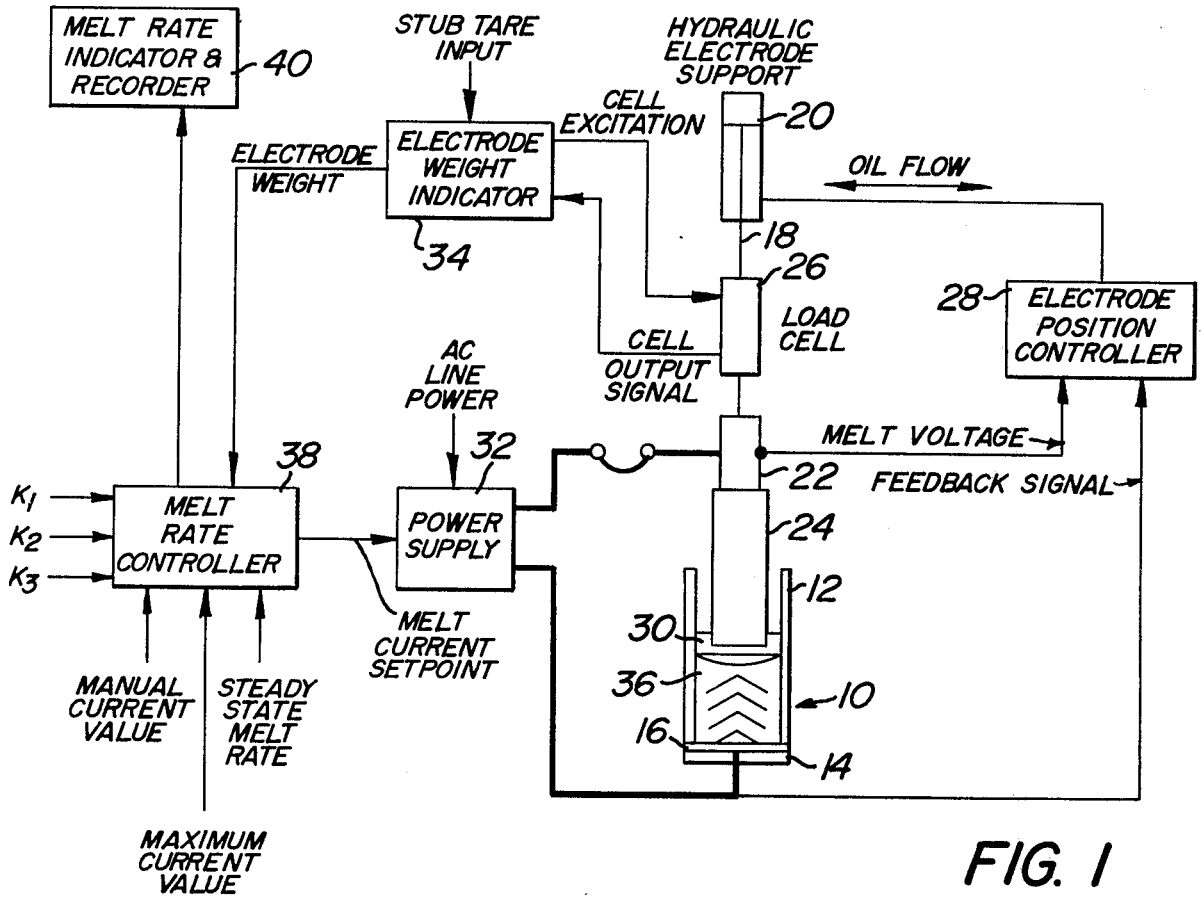
FIG. 1 is a schematic illustration of a closed loop control system for operating an electroslag furnace.

Referring now to the drawing in detail, wherein like numerals indicate like elements, there is shown in FIG. 1 a schematic drawing of a closed loop control system for an electroslag furnace. The invention is exemplified in relation to the operation of an electroslag remelting furnace 10. However, it should be understood that this is by way of example, not limitation, and the invention is also applicable to the operation of other types of remelting furnaces such as vacuum arc and plasma arc.

The electroslag remelting furnace 10 may be any known fluid cooled furnace for melting cylindrical ingots having a substantial diameter to height ratio or non-cylindrical ingots of comparable dimensions. The furnace 10 may include a fluid (e.g., water) cooled crucible 12 removably fixed to a fluid (e.g., water) cooled base plate 14. If desired, a starter plate 16 may be positioned on top of the fluid cooled base plate 14.

The furnace 10 also includes an electrode support 18 whose vertical position is controlled by the hydraulic ram 20. The electrode support 18 includes a stub clamp (not shown) that mechanically engages the stub 22 which is welded to the electrode 24. The electrode support 18 thus supports and controls the vertical position of the electrode 24 within the crucible 12.

A load cell 26 is mounted on the electrode support 18 and serves to provide an electrical output signal that is proportional to the weight of the electrode 24 as it is melted. The load cell may be of the strain gauge type although other types may be used. The load cell should be designed to minimize errors caused by temperature changes and strong magnetic fields, both of which are normally present in the area of an electroslag furnace.

The hydraulic ram 20 is controlled by the electrode position controller 28 which senses the voltage between the electrode 22 and the furnace 10 and uses the sensed voltage to maintain the lowermost end of the electrode 24 at the proper position within the pool of molten slag 30. An electromechanical system can be used in place of the hydraulic system shown in FIG. 1.

Electrical power for operating the furnace 10 is provided by the power supply 32 which in turn is connected to the local utility power line. The output current of the power supply is controlled automatically at the value determined by the melt rate controller 38.

The electrode weight indicator 34 provides an electrical excitation signal to the load cell 26 and detects changes in an output signal as a measure of the change in weight of the electrode 24 as it is fused to form the ingot 36. The electrode weight indicator 34 is provided with a stub tare input to compensate for the weight of the stub 22 so that its output is the tare weight of the electrode 24.

All of the foregoing described elements of the electroslag remelting furnace 10 have heretofore been used in furnaces and may be purchased from manufacturers of such furnaces. In particular, the furnace 10 or parts thereof may be obtained from Consarc Corporation of Rancocas, N.J. See also U.S. Pat. No. 3,684,001 for a more detailed showing of an electroslag furnace.

In accordance with the present invention, the furnace 10 is also provided with a melt rate controller 38. One of the outputs of the melt rate controller 38 is the melt current set point which is connected to the electrical power supply and establishes the melting current to which the furnace is ultimately to be adjusted in accordance with the operation of the closed loop system described herein. The melt rate controller 38 also includes a melt rate indicator and recorder 40 for simultaneously displaying and recording the melt rate in weight per unit time. By way of example, but not limitation, the melt rate controller 38 may be a Tektronix Model TEK31 programmable calculator. If desired, the melt rate controller 38 could be a microcomputer using any one of a number of available microprocessor chips. The melt rate controller 38 could also be an analog device, as controllers capable of handling equations, such as equation 1, are known and have been used in industrial processes.

As indicated by the arrows, the inputs to the melt rate controller 38 include electrode weight, the constants $K_1$, $K_2$ and $K_3$, manual current value (I Manual), and the steady state melt rate (SSMR) and maximum current value (I Max). The purpose and function of the foregoing values can be understood from what is set out below.

In operating the furnace 10, it is desirable to operate at the maximum possible melt rate to maximize productivity and minimize the cost of remelting the electrode. However, excessive melt rates deleteriously effect the quality of the ingot 36. For this reason, furnaces of the type 10, whether manually or automatically controlled, have carefully controlled the initial start up current to minimize the initial melt rate overshoot. The present invention recognizes that this is not necessary because the initial permissible melt rate can be higher while forming the bottom of the ingot due to the additional cooling provided in the base plate 14. After a certain period of time, the ingot acts as a heat insulator and the base plate cooling is no longer effective for cooling the middle and top of the ingot 36. In accordance with the present invention, the melt rate is rapidly increased at the beginning of the melt by establishing a high initial current which will rapidly bring the melt rate up to and past the desired steady state or set point melt rate value. The overshoot of the melt rate is then compensated for by using the melt rate controller 38 in accordance with the following equations:

$$I\,\text{Melt} = I\,\text{Manual} - I\Delta \quad (1)$$

where:

I Melt is the value of the melting current; and

I Manual is the initial current value fixed by the furnace operator.

ΔI is defined according to the following equation:

$$\Delta I = K_1 e + K_2 \int e \cdot dt + K_3\, de/dt \quad (2)$$

where:

e is the instantaneous difference between actual melt rate and the melt rate set point.

$K_1$ is a proportional constant.

$K_2$ is an integral constant.

$K_3$ is a rate constant.

The constants $K_1$, $K_2$ and $K_3$ are selected based upon tests of an operating furnace to provide the desired melt rate profile in conjunction with the selected value of I Manual. These constants will vary depending upon material being melted, electrode and crucible size, and other factors.

The advantages of operating the furnace 10 in accordance with equation (1) are best understood by describing an electrode melt.

At the start of the melt, the melting current is set and maintained at a fixed level (I Manual) determined by the furnace operator. This level should be sufficiently high to cause the melt rate to exceed the melt rate set point which in the example given is the steady state melt rate. The steady state melt rate is known from past experience in operating furnaces, such as the electroslag remelting furnace 10. Once the melt rate reaches the set point melt rate, the level of melting current I Melt is controlled by equation (1) and used as the set point value for the power supply 32. To obtain the desired melt rate profile and overshoot, it is desirable that I Manual be significantly higher than the current required to achieve the set point or steady state melt rate and that the values of $K_1$, $K_2$ and $K_3$ are such that the integral term is the dominant term of control equation (1). In many instances, satisfactory operation may result with $K_3 = 0$; that is, proportional plus integral control only.

It should be noted that most electroslag remelting furnaces are typically used to make a range of different ingot sizes. When melting smaller ingots, the maximum current that the power supply is capable of providing may be excessive. It is therefore advantageous to establish an absolute maximum (I Max) for the value of I Melt.

All of the inputs to the melt rate controller 38 can be stored on punched cards or magnetic tape and fed into the melt rate controller 38 from an appropriate card or tape reader.

Figure 2:
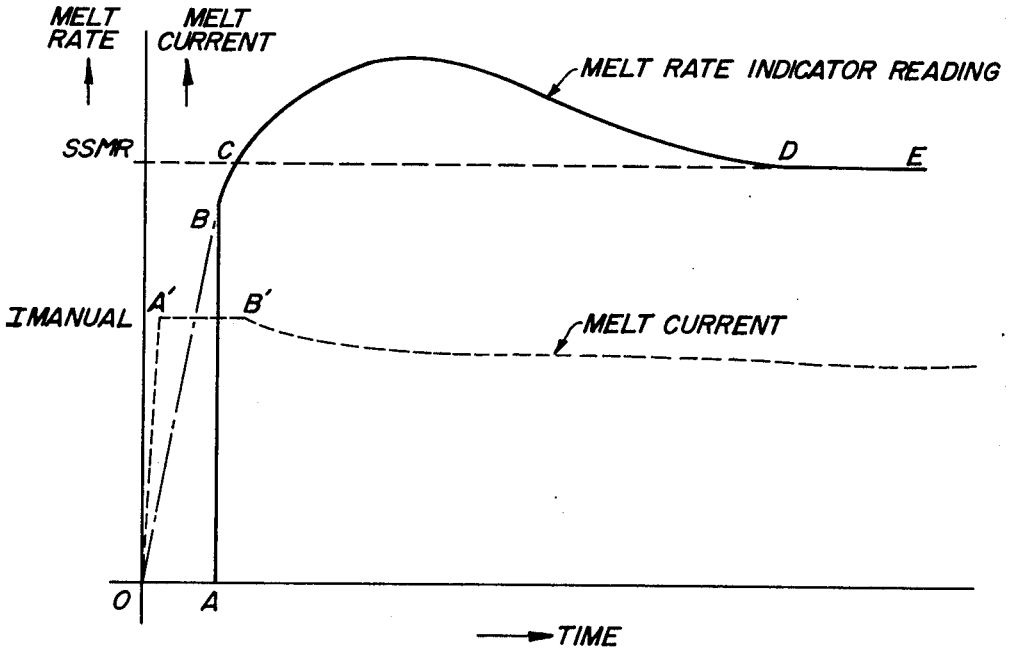
FIG. 2 is a graphical plot showing the typical profile of current and melt rate as a function of time during the initial time period of interest in the present invention.

The operation of the furnace 10 and its control system can be further understood by referring to FIG. 2 which is a graphical plot of melt rate and melt current against time.

Once the furnace has been started (by appropriate starting procedures), the melt current is rapidly raised to the value I Manual as shown by the curve 0A'. The current is held at this value as shown by the curve A'B'.

The probable curve for the melt rate during the time OA is illustrated by the chain dotted line OB, but it should be understood that this particular curve is speculative because it cannot be observed. During the time OA, the melt rate indicator is still accumulating data on the decreasing weight of the electrode. At time A, sufficient data have been gathered and analyzed and the first melt rate reading becomes available. Thereafter, the weight data is continuously updated by the electrode weight indicator 34 and analyzed to provide melt rate readings such as curve BCDE.

At time C, the indicated melt rate reaches the steady state melt rate set point. The melt rate controller 38 then starts to reduce the melting current by the quantity ΔI calculated from control equation (1). As a result of this decrease in I Melt indicated by the melt current curve after point B', the melt rate increase becomes less rapid, the melt rate reaches a maximum value and then declines toward the steady state melt rate.

The curve BCDE defines the overshoot profile. The curve given in FIG. 2 is illustrative only. Obviously, the overshoot profile will vary from furnace to furnace and melt to melt.

By careful selection of the I Manual current as well as the constants of the control equation, the melt rate overshoot and the length of time during which the melt rate exceeds the melt rate set point can be matched to the higher melt rate permissible at the bottom of the ingot as previously indicated. This is possible because of the additional cooling afforded by the close proximity of the base plate. Increases in melt rate mean increases in the temperature of the molten metal at the head of the ingot. However, the additional cooling provided by the base plate is capable of removing the excessive heat and hence the quality of the metal is not deleteriously effected by the excessive melt rate. Of course, the increased melt rate helps increase the productivity of the furnace.

The illustrative operation of the furnace has been described in relation to a steady state melt rate set point signal. This is a preferred method of operating the furnace 10 because it eliminates the need for auxiliary devices or program curves for adjusting the melt rate set point signal. Of course, the melt rate controller could be programmed to vary the melt current set point as a function of time if desired.

The present invention may be embodied in other specific forms without departing from the spirit or essential attributes thereof and, accordingly, reference should be made to the appended claims, rather than to the foregoing specification as indicating the scope of the invention.

I claim:

1. A method of melting a consumable electrode at an increased melt rate in a fluid cooled consumable electrode furnace using a closed loop control system for controlling the melt rate, including:

establishing the initial melting conditions in the control system so as to cause the melt rate to initially exceed the control system melt rate set point; and then causing the melt rate to return to the melt rate set point over the period of time while the first portion of the ingot is being formed.

2. A method of melting a consumable electrode in a consumable electrode furnace in accordance with claim 1 wherein the melt rate is caused to exceed the set point melt rate by establishing the initial electrical power at a value which is in excess of that required to bring the melt rate to the set point melt rate, and then reducing the power below the initial value when the melt rate has exceeded the melt rate set point.

3. A method of melting a consumable electrode in a consumable electrode furnace in accordance with claim 2 in which electrical power is supplied from a power supply having a regulatable output melting current and in which the control of the power level by the closed loop melt rate control system is effected by varying the output melting current of the power supply.

4. A method of melting a consumable electrode in a consumable electrode furnace in accordance with claim 1 wherein the consumable electrode remelting process is an electroslag process.

5. A method of melting a consumable electrode in a consumable electrode furnace in accordance with claim 1 wherein the consumable electrode remelting process is a vacuum arc remelting process.

6. A method of melting a consumable electrode in a consumable electrode furance in accordance with claim 1 wherein the consumable electrode remelting process is a plasma arc remelting process.

7. A method of melting a consumable electrode in a consumable electrode furnace in accordance with claim 3 wherein the output melting current is regulated in accordance with the following equations:

$$I\,\text{Melt}\,(=)\,I\,\text{Manual} - \Delta I \qquad (1)$$

where:

I Melt is the value of the melting current; and

I Manual is the initial current value fixed by the furnace operator, $$\Delta I = K_1 e + K_2 \int e \cdot dt + K_3\, de/dt \qquad (2)$$

where:

e is the instantaneous difference between actual melt rate and the melt rate set point;

$K_1$ is a proportional constant;

$K_2$ is an integral constant; and $K_3$ is a rate constant.

8. A method of melting a consumable electrode in a consumable electrode furnace in accordance with claim 1 including controlling the melt rate by measuring the decreasing weight of the electrode being melted.

9. A method of melting a consumable electrode in accordance with claim 1 wherein the control system melt rate set point is at a steady state value throughout the time that the electrode is being melted.

10. A method of melting a consumable electrode at an increased melt rate in a fluid cooled electroslag remelting furnace using a closed loop control system, including:

establishing the initial melting conditions in the control system to cause the melt rate to initially exceed the control system melt rate set point;

then causing the melt rate to return to the melt rate set point over a period of time while the first portion of the ingot ingot being formed;

said melt rate being caused to exceed the control system melt rate set point by establishing the initial electrical power at a value which is in excess of that required to bring the melt rate from start up conditions to the melt rate set point; causing the melt rate to return to said set point by reducing the electrical power below the initial value when the melt rate has exceeded the melt rate set point;

controlling the electrical power through a power supply having a regulatable output melting current by using the closed loop melt rate control system to vary the output melting current of the power supply; and regulating the output melting current in accordance with the following equations:

$$I\,\text{Melt} = I\,\text{Manual} - \Delta I \qquad (1)$$

where:

I Melt is the value of the melting current; and

I Manual is the initial current value fixed by the furnace operator $$\Delta I = K_1 e + K_2 \int e \cdot dt + K_3\, de/dt \qquad (2)$$

where:

e is the instantaneous difference between actual melt rate set point;

$K_1$ is a proportional constant;

$K_2$ is an integral constant; and $K_3$ is a rate constant.

11. A method of melting a consumable electrode in an electroslag remelting furnace in accordance with claim 9 including measuring the melt rate by monitoring the decreasing weight of the electrode.

* * * * *